United States Patent [19]

Faranetta et al.

[11] 4,270,961

[45] Jun. 2, 1981

[54] METHOD OF MANUFACTURING A SEALED CABLE EMPLOYING AN EXTRUDED FOAM BARRIER

[75] Inventors: John G. Faranetta, Rocky Hill; Robert G. Feller, West Milford, both of N.J.

[73] Assignee: The Okonite Company, Ramsey, N.J.

[21] Appl. No.: 83,540

[22] Filed: Oct. 10, 1979

[51] Int. Cl.[3] ..... H01B 13/14; H01B 13/18; H01B 13/22

[52] U.S. Cl. ..... 156/51; 156/79; 156/206; 428/313

[58] Field of Search ..... 156/47, 48, 51, 52, 156/49, 50, 53, 205, 206; 428/36, 313, 315; 174/110 F

[56] References Cited

U.S. PATENT DOCUMENTS

| | | | |
|---|---|---|---|
| 3,344,228 | 9/1967 | Woodland et al. | 156/79 |
| 3,410,932 | 11/1968 | Woodson et al. | 428/313 |
| 3,567,846 | 3/1971 | Brorein | 156/48 |
| 3,687,748 | 8/1972 | Clock et al. | 428/315 |
| 3,710,440 | 1/1973 | Nevin et al. | 156/48 |
| 3,814,659 | 6/1974 | Nadeau | 428/322 |
| 3,985,951 | 10/1976 | Harris | 428/315 |
| 3,986,253 | 10/1976 | Harris | 428/315 |
| 4,002,787 | 1/1977 | Bailly | 428/36 |
| 4,104,480 | 8/1978 | Thompson | 156/48 |

FOREIGN PATENT DOCUMENTS

| | | | |
|---|---|---|---|
| 2143836 | 3/1972 | Fed. Rep. of Germany | 156/79 |

*Primary Examiner*—William J. Van Balen

*Attorney, Agent, or Firm*—Hopgood, Calimafde, Kalil, Blaustein & Lieberman

[57] ABSTRACT

An improved method for producing sheathed cable which includes an inner insulated conductor/conductor group, an outer corrugated metal sheath, and a barrier layer of a closed-cell foam disposed therebetween to prevent the passage of gas or vapors via the cable. The method includes the steps of extruding a heat activated closed cell foam about the insulated conductor, forming an outer sheath around the foam, and activating the foam to fill the space between the inner and outer sheaths. In accordance with varying alternative embodiments of the invention, the extruded barrier foam layer may be continuous or interrupted; and/or may comprise an already foamed material compressed by formation of the outer metallic sheath.

4 Claims, 2 Drawing Figures

METHOD OF MANUFACTURING A SEALED CABLE EMPLOYING AN EXTRUDED FOAM BARRIER

BACKGROUND AND SUMMARY OF THE INVENTION

This invention relates generally to a method for the production of continuous sheathed cable. Specifically, the invention is directed to a method for producing continuous sheathed cable that will not transmit gas or vapors and, accordingly, is usable in corrosive or explosive ambient environments.

The improved method permits the continuous production of sheathed corrugated cable utilizing a foam of the closed cell type to prevent passage of gases or vapors. The composite cable formed by the instant methodology includes an insulated and often jacketed conductor or conductor ensemble, an outer metal corrugated sheath having a continuous welded seam, and a layer of closed cell foam disposed between the conductor assembly and the outer sheath. The improved method includes extruding a layer of foam around the insulated conductor, forming an outer sheath to encase the foam, and activating the foam by application of heat (for an initially non-foamed type) to expand the foam and fill the space between the inner and outer members. The barrier foam may be continuously or periodically extruded along the length of cable; and may be foamed in situ or prior to its application to the cable.

Many national and local building and electrical codes require sealed, sheathed cable to meet rigorous standards with regard to the transmission of gases or vapors through the core of the cable. One such standard is set out in the National Electrical Code promulgated by the National Fire Protection Association at Article 501, Paragraph (e)(2) which limits gas or vapor flow through a cable to a maximum of 0.007 cubic feet per hour of air at a pressure of 6 inches of water. The sheathed cable produced by the improved method of the present invention fully meets the National Electrical Code standard.

Accordingly, it is an object of this invention to provide an improved method for production of continuous sheathed cable.

It is another object of this invention to provide an improved method for producing sheathed cable which is impervious to the passage of gas or vapors.

It is another object of this invention to provide an improved method for producing sheathed cable utilizing an activatible closed cell foam.

BRIEF DESCRIPTION OF THE DRAWINGS

For a better understanding of the invention, reference is made to the following drawings, taken in connection with the detailed specification to follow, in which.

DESCRIPTION OF THE PREFERRED EMBODIMENT

Figure 1A:
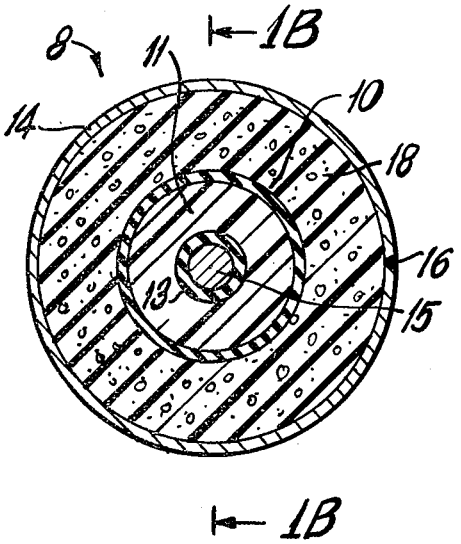
FIGS. 1A and 1B are respectively radial and axial cross-sectional views of the sheathed cable constructed in accordance with the improved method of the present invention.

FIG. 1 illustrates a continuous sheathed cable 8 fabricated in accordance with the principles of the instant invention. The composite cable to be foamed includes a conductor or conductor group 15, i.e., any combination of individual conductors, multistrand or multiconductor groups or the like. The area in and about the individual conductors of the conductor group 15 is advantageously sealed in view of the gas and vapor blocking requirement for the cable 8 of the instant invention in any manner per se well known to those skilled in the art, e.g., by employing a compressible filler material. Disposed about the center conductor 15 is a layer of a semiconducting material utilized for its traditional purpose of eliminating local air voltage breakdown (corona) by converting the irregular outer conducting surface of the individual conductors in element group 15 to the regular outer surface of the semiconductor layer 13. Disposed about the semiconductor layer 13 are an insulator 11 and a cable core jacketing material 10 of any well known type.

A corrugated metallic sheath 14, e.g., formed of aluminum, is disposed about the jacket 10 and its interior elements and is employed to provide mechanical protection and integrity for the composite cable 8. The aluminum sheath 14 contains weld seam 16 along its longitudinal axis.

The volume between the outer cable sheath 14 and the cable jacket 10 and its interior elements contains a barrier, vapor or gas flow blocking material 18 such as a closed pore foam. Many foamable elastomeric materials are well known to those skilled and suitable for instant purposes, for example, close pore foamed Neoprene, Hypolon, ethylene propylene rubber, polyurethane and the like.

Figure 1B:
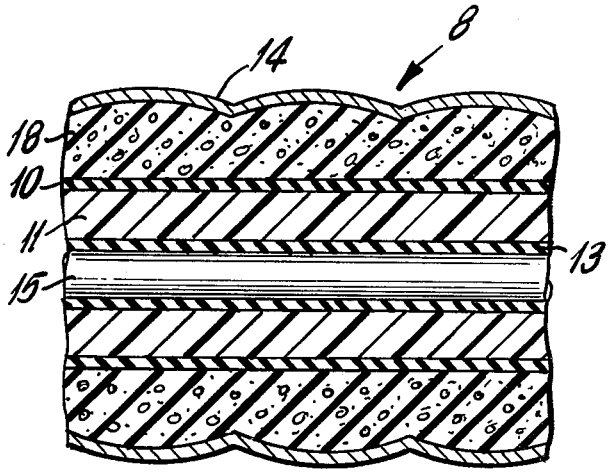

Sealed cable of the method of the instant invention may contain a core of any type including more than or fewer than the elements shown in FIGS. 1A and 1B and discussed above. Thus, for example, such cable cores need not employ a jacket 10 and/or the inner semiconductor layer 13.

Figure 2:
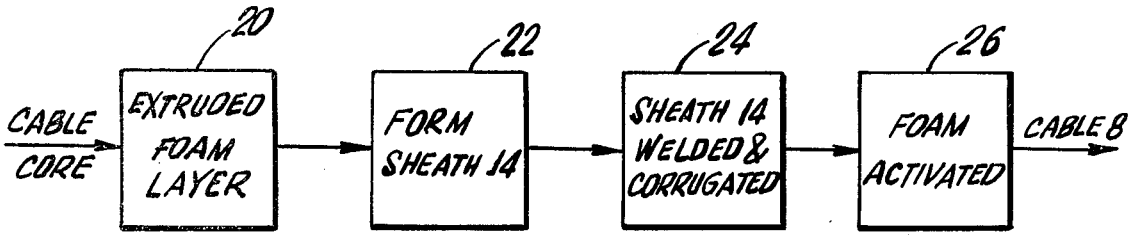
FIG. 2 is a flow diagram of the steps of the improved method.

The method for producing the cable of FIGS. 1A and 1B is set forth in FIG. 2. The cable core comprising the inner conductor 15, insulation 11 and their ancillary components first have extruded thereabout (process step 20) the layer which includes an as yet unactivated foam 18. The foam extrusion may be continuously applied or utilized at spaced intervals. Whether a continuous or spaced foam extrusion is employed, a barrier to passage of potentially harmful vapors via the space between the cable aluminum sheath 14 and the cable core is provided at least at those locations where the foam is present.

Following application of the extruded layer, the aluminum shield is formed (operation 22) and corrugated and welded (operation 24) in the manner per se well known. In brief, sheath 14 formation is typically effected by continuously dispensing the aluminum or other metallic sheath member in strip form; bending the metal about the cable in a forming die; welding the ends of the sheath strip; and forming the outer corrugations via transverse rollers. Finally, the foam 18 is activated (operation 26) by application of heat such that the material 18 expands in volume while the closed pore foam is formed to occupy all of the space between sheath 14 and the cable core. The composite cable is thus sealed, preventing passage therethrough of potentially harmful or explosive fumes, vapors or the like.

The above described implementation utilized an initially uncured foam which was activated in situ by application of heat in process step 26. In an alternative form of the instant invention, the extrusion of step 20 may already bear an activated, expanded foam which is compressed during the corrugation process 24 to provide a mechanical vapor seal. The foam activation step 26 would be omitted for this alternate method.

The above described methodology is merely illustrative of the principles of the present invention. Modifications and adaptations thereof will be readily apparent to those skilled in the art without departing from the spirit and scope of the present invention.

What is claimed is:

1. A method for producing sheathed, non-vapor propagating cable comprising the steps of extruding a layer of a foamable material around an insulated conductor, said foamable material being of the closed cell type after activation by the application of heat; forming an outer metal sheath about said insulated conductor and said foam; corrugating said outer metal sheath and applying heat to activate said foamable material and seal the space between said insulated conductor and said outer metal sheath.

2. A method as in claim 1 wherein said foamable material is extruded about said insulated conductor only at spaced points along the axial length of said insulated conductor.

3. A method for the production of sheathed, non-vapor propagating cable comprising the steps of extruding a layer of foam around an insulated conductor, said foam being of the closed cell type; forming an outer metal sheath about said insulated conductor and said foam; and corrugating said outer metal sheath to compress said foam and seal the space between said insulated conductor and said outer metal sheath.

4. A method as in claim 4, wherein said foam is extruded about said insulated conductor at spaced points along the axial length of said insulated conductor.

* * * * *